US011701907B2

(12) United States Patent
Schlumm et al.

(10) Patent No.: US 11,701,907 B2
(45) Date of Patent: Jul. 18, 2023

(54) PRESSURE DIFFRENTIALS AT PRINTERS

(71) Applicant: Hewlett-Packard Development Company, L.P., Spring, TX (US)

(72) Inventors: Doron Schlumm, Ness Ziona (IL); Mark Sandler, Ness Ziona (IL); Assaf Pines, Ness Ziona (IL); Gideon Amir, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/417,181

(22) PCT Filed: Jul. 29, 2019

(86) PCT No.: PCT/US2019/043952

§ 371 (c)(1),
(2) Date: Jun. 22, 2021

(87) PCT Pub. No.: WO2021/021108

PCT Pub. Date: Feb. 4, 2021

(65) Prior Publication Data

US 2022/0143993 A1 May 12, 2022

(51) Int. Cl.

| | |
|---|---|
| ***B41J 29/377*** | (2006.01) |
| ***B41J 29/02*** | (2006.01) |
| ***B41J 29/38*** | (2006.01) |

(52) U.S. Cl.

CPC ..... *B41J 29/377* (2013.01); *B41J 29/02* (2013.01); *B41J 29/38* (2013.01)

(58) Field of Classification Search

CPC ..... B41J 29/377; B41J 29/02; B41J 29/38
See application file for complete search history.

(56) References Cited

U.S. PATENT DOCUMENTS

| | | | |
|---|---|---|---|
| 4,343,096 | A | 8/1982 | Bergland |
| 5,354,540 | A | 10/1994 | Neumiller |
| 5,451,140 | A | 9/1995 | Johnsen, Jr. et al. |
| 7,187,885 | B2 | 3/2007 | Baker et al. |
| 7,258,761 | B2 | 8/2007 | Liu et al. |
| 8,351,815 | B2 | 1/2013 | Eden et al. |
| 8,488,988 | B2 | 7/2013 | Lee et al. |
| 2002/0040640 | A1 | 4/2002 | Hsu et al. |
| 2011/0181907 | A1 | 7/2011 | Asafuku |
| 2016/0286668 | A1 | 9/2016 | Tomoda et al. |
| 2019/0184640 | A1 | 6/2019 | Winters |

(Continued)

FOREIGN PATENT DOCUMENTS

| | | | |
|---|---|---|---|
| CN | 2919334 | Y | 7/2007 |
| CN | 103862857 | A | 6/2014 |
| CN | 104960336 | A | 10/2015 |

(Continued)

OTHER PUBLICATIONS

Yun Liu, "VOC Reduction and Control in Beijing Xinhua Printing Co. Ltd ", Printing Technology; Jul. 2018: Full-Text Database; The 7th Issue; Published Country: China, 9 pages.

*Primary Examiner* — Jason S Uhlenhake

(57) ABSTRACT

An example method comprises identifying, by a processor, a gap in a housing of a printing apparatus and positioning an inlet of a conduit inside the housing proximate the gap. The inlet is fluidly connected to a fan, and the fan is powered to create a pressure differential across the housing to minimize the amount of air inside the housing being able to escape the housing via the gap.

15 Claims, 6 Drawing Sheets

(56) References Cited

U.S. PATENT DOCUMENTS

2019/0227485 A1 7/2019 Hamasaki et al.

FOREIGN PATENT DOCUMENTS

| | | | |
|---|---|---|---|
| CN | 106019911 | A | 10/2016 |
| CN | 207014964 | U | 2/2018 |
| CN | 108107940 | A | 6/2018 |
| CN | 108225003 | A | 6/2018 |
| EP | 2743087 | A1 | 6/2014 |
| RU | 76272 | U1 | 9/2008 |
| WO | WO-2013071397 | A1 | 5/2013 |
| WO | WO-2013116599 | A1 | 8/2013 |
| WO | WO-2016205173 | A2 | 12/2016 |

PRESSURE DIFFRENTIALS AT PRINTERS

BACKGROUND

A printing apparatus may use printing fluids comprised of a mixture of printing fluid solid suspended in a carrier in printing an image to a substrate.

BRIEF DESCRIPTION OF DRAWINGS

Examples will now be described, by way of non-limiting example, with reference to the accompanying drawings, in which.

DETAILED DESCRIPTION

Figure 1:
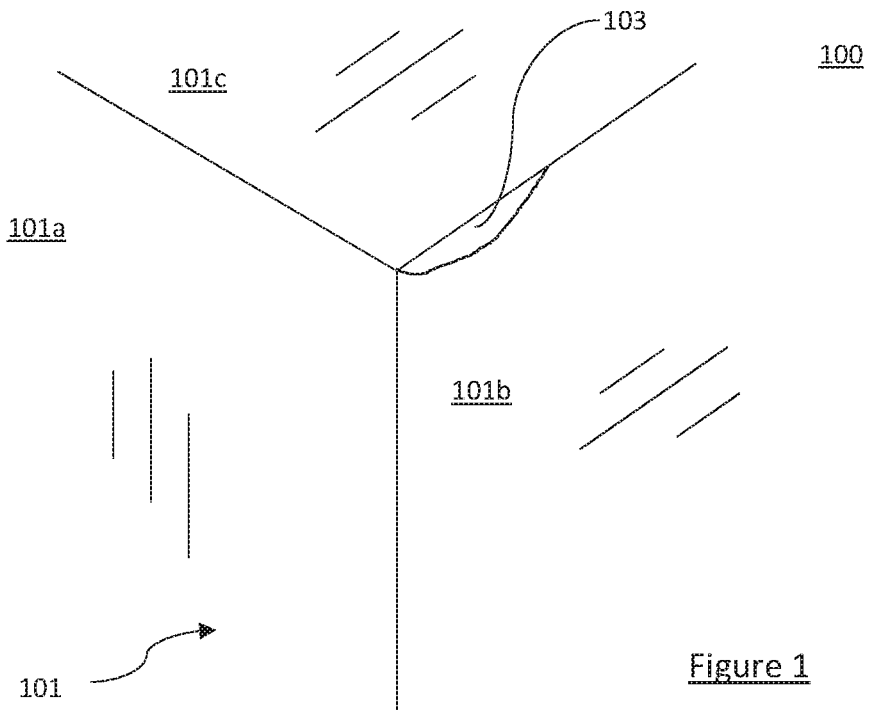
FIG. 1 is a simplified schematic of part of an example printing apparatus.

During a printing operation, printing fluid (e.g. an ink) may be used to print an image to a substrate by coating the areas of the substrate corresponding to the image with printing fluid. The printing fluid may be a homogenisation of printing fluid solids (e.g. ink solids) and a printing fluid carrier (e.g. an ink liquid carrier). Some printing fluids are therefore a suspension of printing fluid solids in the printing fluid carrier. During a printing operation the printing fluid solids are deposited on a substrate to "ink" the substrate and print the image thereon. This can result in printing fluid carrier being present in the printing system (either as a liquid or as printing fluid vapour). The printing fluid carrier may comprise harmful elements, such as volatile organic compounds (VOCs). Air inside the printing apparatus may therefore contain noxious or otherwise harmful particles which can therefore be at risk of being released to the environment from within the printing apparatus. Therefore, the emissions of VOCs, e.g. from such a printing apparatus, are regulated (regulations may apply both during a print job and when the printing apparatus is not printing). For example, the VOC concentration of air inside some printing apparatuses may be as high as approximately 250-330 ppm, and one regulation may stipulate that the concentration of VOCs in air outside the printing apparatus should be under 10 ppm. Some printing apparatuses are therefore concerned with controlling and minimising emissions of VOCs from within the apparatuses, for example to comply with local regulations.

Emissions of a VOC may be defined according to the formula: $\Sigma QiCi$. Here, i represents a location in a given air volume i, Qi is the volume of air at the location i, and Ci is the concentration of VOCs at the location i. The sum is performed for each location i and therefore this formula may be used to calculate the total VOC emissions in a given air volume.

Minimising the VOC concentration in the room containing the printing apparatus, to thereby ensure the safety of the operators of the printing apparatus, may be achieved by reducing the concentration of VOCs (e.g. the concentration of VOCs inside the printing apparatus), for example by diluting air at or near the printing apparatus with "clean" air, e.g. from outside the room in which the printing apparatus is located. In this example, air from within the printing apparatus may be removed and replaced with the clean air from the outside. Effectively, air containing potentially high VOC concentration is emitted from the printing apparatus, but is then removed from the room and replaced with clean air from outside the room. In this way, the safety of operators of the printing apparatus may be effectively prioritised but the high flow rate of air proximate the outside of the printing apparatus to evacuate the air from the vicinity of the operator may mean that it can be difficult to treat the air (to lower the VOC concentration) prior to releasing it (e.g. to the environment). Another way of minimising harmful emissions may be to perfectly seal the printing apparatus to ensure that there are no gaps or openings in the printing apparatus casing from which harmful air from within the printing apparatus can escape to outside the printing apparatus, for example by joining components of the printing apparatus housing together such that there are no gaps or by using seals (such as rings or sealer bands). Such perfect sealing however may be costly to achieve. Even when a printing apparatus is manufactured with such perfect sealing in mind, either due to cost or functionality of the apparatus, such a perfect seal may not be completely achieved, and gaps or openings, through which air from inside the apparatus may escape, may still be present in the printing apparatus. For example, some printing apparatuses have air escaping through the bottom of the apparatus, at or near the opening of the paper path, at or near the computer cabinet or the apparatus, through gasket openings, at or near the substrate (e.g. paper) exit etc.

Some examples herein relate to creating an under-pressure inside a printing apparatus (or printing system). The printing apparatuses or systems described herein may comprise a printer. For example the printing apparatuses and/or systems described herein may comprise a printer suitable for transferring an image onto a substrate or print medium (e.g. inking the substrate or print medium with printing fluid), for example by transferring an inked image on an intermediate transfer member to the substrate (e.g. part of a press comprising a binary ink developer (BID) assembly), or a printer suitable for inking a substrate or print medium, for example using page wide array (PWA) printheads that employ a plurality of printhead dies, each including a plurality of nozzles for ejecting droplets of ink in a controllably sequenced manner to form a desired image onto a substrate or print medium advancing below the nozzles. The substrate may comprise a paper, plastic or fabric material. In other examples, the printing apparatuses and/or systems described herein may comprise a printer (e.g. a 3D printer) suitable for fabricating a three-dimensional object by additive manufacturing by depositing a build material in a build bed and applying energy (e.g. by laser or heat lamp) to heat the build material so that it fuses into the object.

Some examples herein relate to creating (and controlling) an under-pressure at or near the "skin" of a printing apparatus (or system) such that, if the apparatus is not perfectly sealed, air will be drawn into the apparatus instead of being released out of the printing apparatus. Therefore, by "under-pressure" it is meant a negative, or suction, air pressure. By creating an under-pressure state inside a printing apparatus, air will therefore be drawn into the printing apparatus through any imperfect seals in the skin. By "skin" it is meant the printing apparatus housing, casing, or shell etc., e.g. the physical interface between the interior of the printing apparatus and the exterior of the printing apparatus. In some examples, emissions may be mapped to determine the locations within the printing apparatus from which air is being emitted and the under-pressure may be created locally, at or proximate to those locations from which air is being emitted. In this way, the under-pressure, or negative pressure, state is created at locations from which potentially harmful air is at risk of being emitted. Some examples are related to predicting those areas of the printing apparatus which have air at higher VOC levels and creating the under-pressure states at those areas. For example, during a particular print job a first printing station may be idle and hence the emissions in this area of the printing apparatus are likely to be low. Conversely, in this example, the emissions in the area of a second printing station that may be exclusively used for this print job are likely to be higher and therefore, according to some examples herein, the under-pressure is create at, near, or proximate to the second printing station—for example, during a printing operation emissions may be higher, or highest, proximate a part of the printing system, or apparatus, that is likely to be in contact with, or proximity to, printing fluid. For example, proximate a developer roller, intermediate transfer member, photoconductive member, squeegee roller, impression roller etc. (either at or proximate to these elements themselves or mechanical components forming part of the system, e.g. an intermediate transfer belt), or proximate a printhead die, depending on the type of printing system. In this way, the state of the printing system may influence the location at which the under-pressure is created. For example, the emissions may depend on whether the printing apparatus is in a "print" state as opposed to a "get ready" state since, during "get ready" there may be no additional generation of VOCs and the emissions of VOCs from the printing apparatus may be evenly distributed. Conversely, during printing, VOCs may be concentrated proximate a printing zone, for example proximate a developer roller, intermediate transfer member, photoconductive member, squeegee roller, impression roller etc., or proximate a printhead die, depending on the type of printing system.

FIG. 1 shows a portion of an example printing apparatus (or printing system) 100. FIG. 1 shows that the printing apparatus comprises a casing or housing 101 (for example the exterior of the printing apparatus) that may comprise a number of panels 101*a-c* that are joined together (e.g. bolted, screwed, sealed, welded etc.). The casing 101 that forms the exterior of the printing apparatus 100 may not be perfectly sealed or joined together and, accordingly, a gap or opening—schematically indicated at 103—may be present in the printing apparatus housing. For example, two panels forming a wall of the printing apparatus may be joined via a bracket such that a small air channel is present between the join of the two panels. The gap 103 may therefore be present because, in some examples, it is not possible to form a perfect air seal between the interior and the exterior of the printing apparatus. In the example printing apparatus of FIG. 1, air inside the printing apparatus may contain VOCs, for example at a concentration of 250-300 ppm, and therefore air containing above regulation levels of noxious gases is at risk of being released to the environment via the gap 103. Accordingly, some examples herein provide a printing apparatus as shown in the example of FIG. 2.

Figure 2:
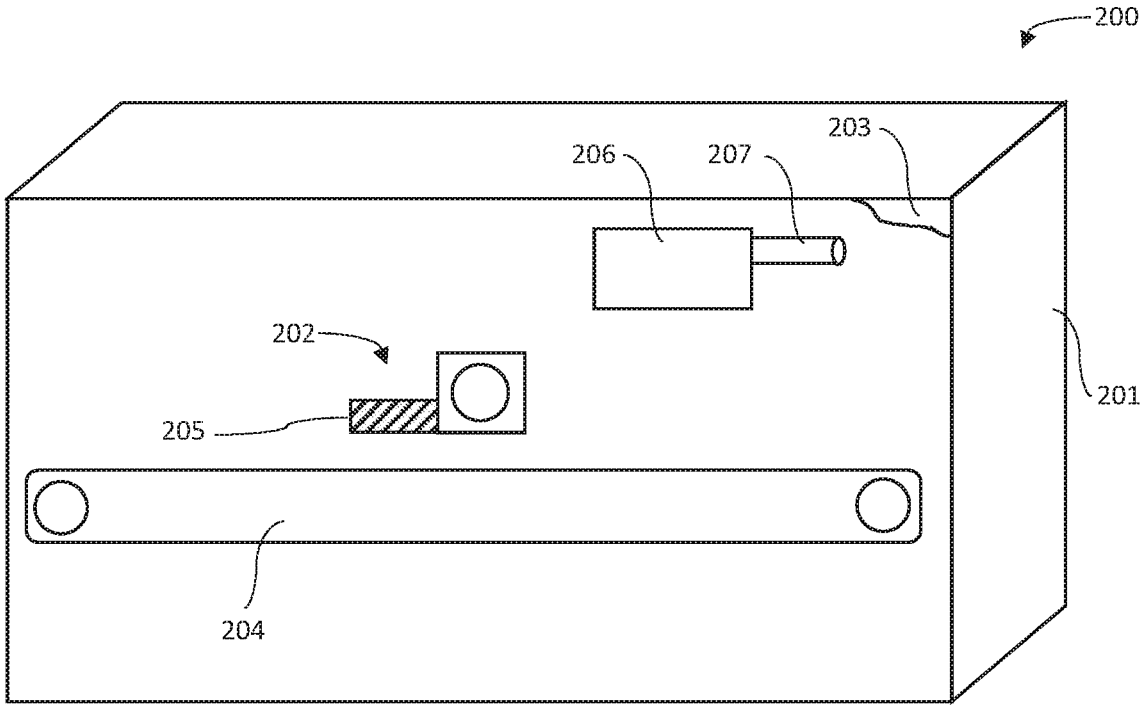
FIG. 2 is a simplified schematic of an example printing apparatus.

FIG. 2 shows an example printing apparatus 200, which may comprise the example printing apparatus 100 as shown in FIG. 1. The example printing apparatus 200 comprises a casing 201. The casing 201 may comprise a housing skin or exterior shell etc. of the printing apparatus. The casing 201 may, at least in part, define an interior and an exterior of the printing apparatus. In other words, the casing 201 may define a first region being an interior of the printing apparatus and a second region being an exterior of the printing apparatus, the casing being a boundary therebetween. The casing 201 is for a printing element 202 which may be any element for performing any part of a printing process or print job. In the example of FIG. 2, the printing element 202 is depicted as a carriage to deposit printing fluid, such as ink, droplets onto an advancing substrate to print an image to the substrate. In the example of FIG. 2 a conveyor 204 to advance the substrate and a printing bar 205 attached to the carriage 202 and about which the carriage moves to make passes across the substrate (when moving along the conveyor 204) are also shown. Accordingly, the portion of the printing apparatus 200 depicted in FIG. 2 may comprise a printing station. However, in other examples the printing element may not be a component of a printing station and accordingly the printing apparatus 200 may comprise a station other than a printing station.

The printing element 202 may utilise printing fluid to print an image to a substrate and, accordingly, the air inside the printing apparatus 200 may contain above recommended amounts of noxious gas, such as VOCs. For example, the concentration of VOCs within the printing apparatus 200 may be between 250-300 ppm, as described with reference to FIG. 1 above, which well exceeds most acceptable and regulated levels of VOC concentration in the air. As such, air from within the printing apparatus 200 should not be released to the environment, at that level of concentration of VOC.s The printing apparatus casing 201 comprises a gap 203 from which air may pass from the inside to the outside of the printing apparatus. Therefore, via the gap 203, air at an unacceptable concentration of VOCs is vulnerable to escaping to outside the apparatus where it may come into contact with an operator of the printing apparatus. This is potentially harmful to the operator's health. Accordingly, the printing apparatus 200 comprises a pressure source 206 to create a suction pressure, and a conduit 207 that is fluidly connected to the pressure source 206 and positioned so as to create pressure differential across the casing 201 to minimize the amount of air inside the casing that is able to escape the casing via the gap. For example, the pressure source may be positioned so as to create the pressure differential such that air inside the casing is unable to escape the casing via the gap 203. The pressure source may comprise a fan and/or a blower etc. The pressure source may be, as depicted in the FIG. 3 example, located inside the printing apparatus but in some examples the pressure source may be located outside the printing apparatus. The pressure source may be remote from the printing apparatus.

In this way, the pressure source 206 is to create an under-pressure inside the printing apparatus so that air inside the casing, potentially having a high concentration of VOCs, is unable to escape. The pressure source 206 may therefore be to create an under-pressure inside the printing apparatus proximate, or in the vicinity of, the gap 203. The pressure source 206 may therefore be to create a pressure state inside the printing apparatus, e.g. proximate the gap, such that air outside the printing apparatus is drawn inside the printing apparatus 200 and in this way air inside the printing apparatus is effectively prevented from escaping. Although in some examples the conduit (e.g. an inlet thereof) may be positioned proximate the gap but in other examples the conduit (e.g. An inlet thereof) may be positioned remote from the gap, so long as the pressure differential is created and/or maintained. A negative air pressure may therefore be created near the "skin" of the printing apparatus 200 and this means that, if the apparatus 200 is not perfectly sealed such as is shown in FIG. 2 and comprises a gap 203, air will be drawn into the apparatus through the same gap instead of air inside the printing apparatus migrating outside the apparatus. In this way, emissions of VOCs from the printing apparatus may be mitigated, regulated and/or controlled through the creation of the pressure state within the printing apparatus (e.g. proximate the gap).

As will be explained below with reference to the example of FIG. 3, the air that is drawn from inside the printing apparatus 200 may be routed to a treatment station to undergo a treatment that will reduce the VOC concentration of the drawn air for later release to the environment. Accordingly, the conduit 207 and/or the pressure source 206 may be to route the drawn air to such a treatment station to treat the air.

As will also be explained below with reference to the example of FIG. 3, a plurality of gaps may be present in the casing of the printing apparatus 200 and so the printing apparatus 200 may be to create a suction pressure across the casing, e.g. proximate each gap, such that air is unable to escape via the plurality of gaps. This may comprise using multiple pressure sources (e.g. fans/blowers) and/or multiple conduits. For example, a plurality of blowers may be used each having a conduit, each conduit being positioned proximate, at, or near a gap; and/or one blower may be used having a plurality of conduits extending therefrom, each conduit being positioned proximate, at, or near a gap. In this way, suction (under-pressure) may be created in the printing apparatus regardless of the location of the gaps through which air may escape and the number of fans in the apparatus.

The conduit may be positioned at a location where the VOC concentration of air inside the apparatus 200 is at the lowest, e.g. a minimum. In this way, the air that is taken from the apparatus will be less noxious and may therefore need less treatment before release than if air was taken from locations with a higher concentration of VOCs. In one example, the conduit may be positioned at a location where the differential pressure is the lowest. In this way the differential pressure is created by the pressure source to draw air from a location at which VOC concentration is at a minimum, and so the air flow rate will also be at a minimum, thereby reducing the amount of air that is treated (before release into the environment). In other words, the pressure source may be operated so as to create a minimum differential pressure across the housing and/or the gap. The conduit may be also positioned at a location where there is not a print job occurring or likely to occur (e.g. remote from an ITM drum). In this case the state of the apparatus 200 may be monitored (e.g. "get ready" or "printing") and the conduit may be positioned accordingly. For example, the likelihood of air inside the apparatus containing VOCs is much higher at a section of the apparatus actively printing, or about to print, than at a section not printing or likely to be printing.

Figure 3:
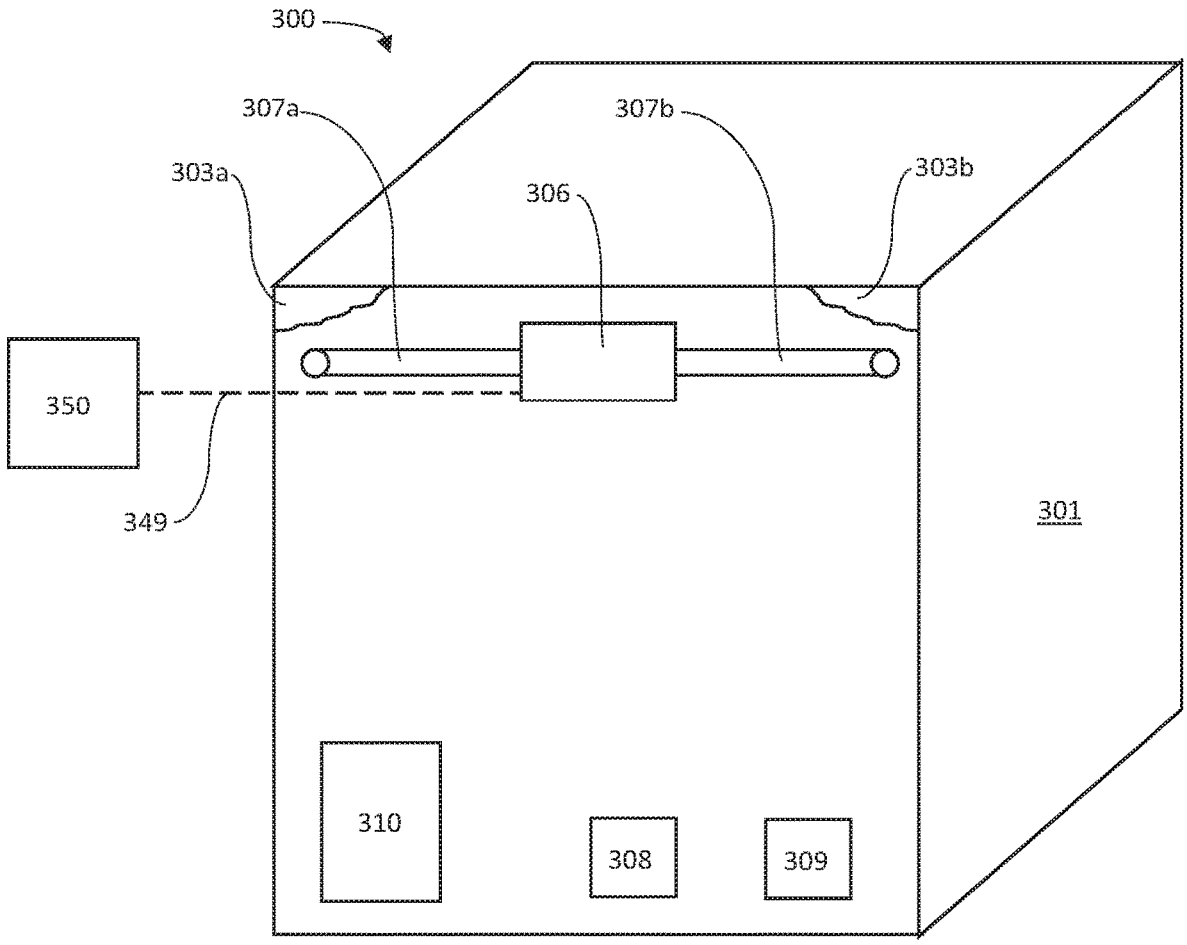
FIG. 3 is a simplified schematic of an example printing apparatus.

FIG. 3 shows a printing apparatus 300 which may comprise the example printing apparatus 100 or 200 as shown in FIGS. 1 and 2, respectively.

The printing apparatus 300 comprises a casing 301 as described above in relation to FIGS. 1 and 2. The casing is for a printing element, not shown in FIG. 3. The casing 301 in the FIG. 3 example comprises a plurality of gaps 303*a*, 303*b*, and a pressure source 306. A plurality of conduits 307*a*, 307*b* are fluidly connected to the pressure source 306 and are to create a pressure differential across the casing 301 such that air inside the casing is unable to escape the casing via the gaps 303*a*, 303*b*.

Although two gaps 303*a*, 303*b* are shown in FIG. 3 in other examples there may be another number of gaps (e.g. 1, 3, 4, etc.). Although a single pressure source 306 is shown in FIG. 3 in other examples a plurality of pressure sources may be used. In this example, a single conduit may be fluidly connected to the plurality of pressure sources, or a respective conduit may be fluidly connected to each pressure source, or a respective plurality of conduits may be fluidly connected to each pressure source. As shown in FIG. 3, a plurality of conduits 303*a*, 303*b*, may be connected to a pressure source 306. Although two conduits are shown 303*a*, 303*b*, any number of conduits may be connected to a, or a plurality of, pressure source(s) in some examples. In the FIG. 3 example, a conduit is provided for each gap but in other examples the number of gaps ad conduits may not be equal. In other words, the number of conduits provided may be less than, or greater than, the number of gaps.

The apparatus 300 comprises a controller 310. The controller may be to regulate the suction pressure of the pressure source 306. The controller 310 may therefore be operatively connected to the pressure source 306 and may be to transmit/receive signals to/from the pressure source 306. The controller 310 may be physically, or wirelessly, connected to the pressure source 306. The controller 310 may be to determine the state of the printing apparatus 300, or to determine the state of a portion of the printing apparatus 300. For example, the controller 310 may be to determine whether a printing station of the printing apparatus is undergoing, or about to undergo, a print job. On this basis, the controller 310 may regulate a pressure source such that all conduits in an area of the printing station not printing are deactivated or drawing air at a low volume since, in this case, the concentration of VOCs in the air in/around the printing station is likely to be at low levels since the printing station is not, and will not be, printing. On the other hand, the controller 310 may regulate a pressure source such that conduits in an area of a printing station that the controller has determined will be printing, or is printing, so that these conduits draw air at a larger volume. In examples where multiple pressure sources are used, the controller may be to regulate the suction pressure of each pressure source (e.g. in response to the state of the printing apparatus).

The printing apparatus 300 of the FIG. 3 example comprises a concentration sensor 308 and a differential pressure sensor 309. The concentration sensor 308 may be to determine the concentration of a VOC within the printing apparatus 300 and the differential pressure sensor 309 may be to determine the differential pressure at a location within the printing apparatus 300 (e.g. proximate a, the, or each gap 303). In this way the controller 310 may effectively determine the amount of VOC that may escape the printing apparatus 300 via the or each gap 303. The controller 310 may be to regulate the suction pressure in the or each conduit based on the determined concentration and/or the differential pressure. For example, the controller may cause a conduit to draw less air from an air volume inside the printing apparatus that has a high concentration of VOCs, in particular if the same pressure differential across a gap (such that air may not escape the printing apparatus via the gap) may be created by drawing air from the lower-VOC-concentration air volume. In this case, the same differential pressure may be created but using less noxious air and therefore less treatment of the drawn air may be performed before the air may be released into the environment. In examples where multiple pressure sources are used, the controller may be to regulate the suction pressure of each pressure source (e.g. in response to a determined concentration and/or pressure differential).

Accordingly, the controller 310 in some examples comprises instructions that, when executed by a processor, control flow as described above with reference to some examples. For example the instructions, when executed by a processor, may cause the processor to be to control flow at a location or a plurality of locations in the printing apparatus 300. For example the instructions, when executed by a processor, may cause the processor to control the suction pressure in a pressure source, and/or in a plurality of pressure sources, and/or in a conduit, and/or in a plurality of conduits depending on the state of the printing system and/or the concentration at a location (e.g. proximate a gap) in the printing apparatus and/or the differential pressure at a location (e.g. proximate a gap), such that air inside the apparatus is unable to escape via any gaps or openings in the printing apparatus casing. The controller 310 may comprise the processor.

The controller 310 may also identify the location of a gap, or opening, or the locations of a plurality of gaps, or openings, and regulate the pressure in a, or a plurality of, conduits accordingly.

The printing apparatus 300 of the FIG. 3 example is associated with a treatment station 350. For this purpose a conduit, channel, or circuit—schematically indicated in FIG. 3 by the dotted line 349—is provided to route air being drawn from the printing apparatus 300 to the treatment station 350. The treatment station may comprise any suitable method of treating (reducing the VOC concentration) of the drawn air before releasing the air to the environment. For example, the treatment station 350 may comprise a catalytic converter at which the drawn air may be heated, treated by the catalytic converter, and then cooled before release into the environment. In another example the treatment station 350 may comprise a filter (such as a Regardless of how the air is treated at the treatment station 350, the released air may be at a lower concentration of VOCs than the air inside the printing apparatus 300.

Figure 4:
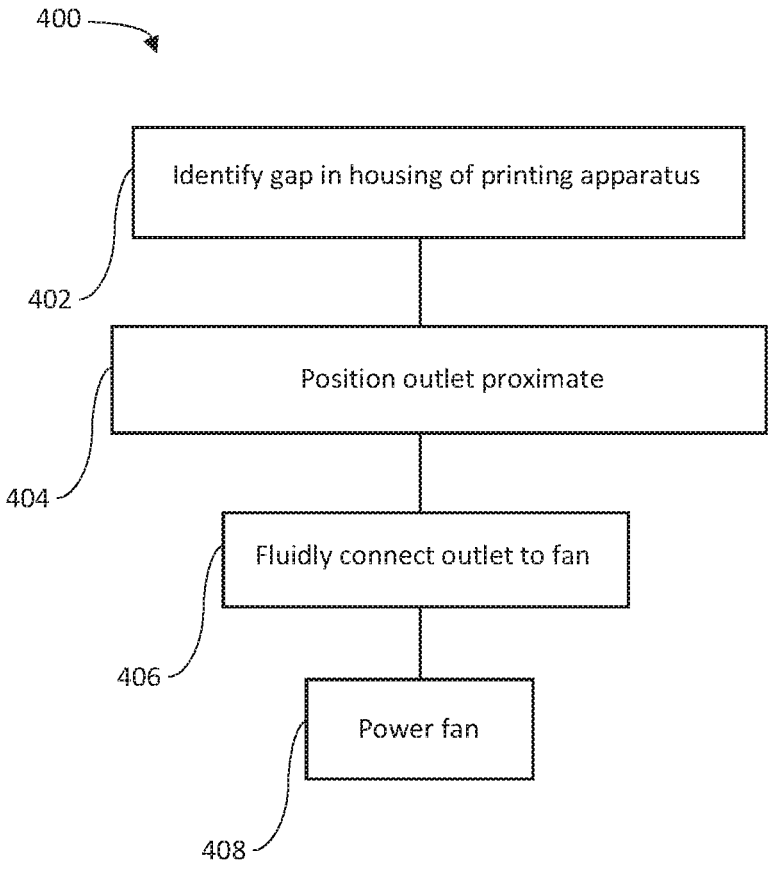
FIG. 4 is a flowchart of an example of a method.

FIG. 4 shows an example method 400, which may be a method of reducing emissions from inside a printing apparatus, or which may be a method of reducing the concentration of volatile organic compounds in the region of a printing apparatus. The method 400 may comprise a computer-implemented method.

At block 402, the method comprises identifying, by a processor, a gap in a housing of a printing apparatus. For example a processor (e.g. forming part of a controller or control system) of a printing apparatus may identify the gap based on an air flow rate, pressure differential, and/or a VOC concentration at a housing location. For example, the gap may comprise an opening in the printing apparatus through which air may escape the printing apparatus. As described above with reference to FIGS. 1-3, the gap or opening may be a result of an imperfect seal in parts of the casing or housing of the printing apparatus, or otherwise a break in the integrity in the outer shell of the printing apparatus through which air may escape. The gap may also be an air gap between two adjacent casing panels, with each panel being part of a different section of the printing apparatus (e.g. different printing stations, for example black and white and colour). As described above with reference to FIGS. 1-3 the air inside the printing apparatus may be at a high VOC concentration. Block 402 may be performed under the control of a controller (such as the controller 310), the controller being to identify a gap or opening in a printing apparatus through which air may escape.

At block 404, the method comprises positioning, e.g. by a controller, inlet of a conduit inside the housing proximate the gap. As will be explained below the inlet is positioned proximate a gap as air proximate the gap will be drawn through the conduit.

At block 406, the method comprises fluidly connecting the inlet to a fan (or, in another example a blower or a pressure source, e.g. a source of negative pressure etc.). Block 406 may be performed by a controller (which may be the same controller as described above with respect to block 404).

At block 408, the method comprises powering the fan to create a pressure differential across the housing to minimize the amount of air inside the housing being able to escape the housing via the gap. Block 408 may be performed by a controller (which may be the same controller as described above with respect to blocks 404-406). Block 408 may comprise powering the fan to create a pressure differential across the housing such that air inside the housing is unable to escape the housing via the gap. Block 408 may be performed under the control of a controller (such as controller 310) and therefore block 408 may comprise operating a controller to power the fan.

Blocks 404-408 of the method therefore comprise creating a pressure differential such that air with high VOC concentration is prevented from escaping via the gap, and thereby preventing VOCs from escaping into the environment outside the printing apparatus. Block 408 may therefore comprise powering the fan to create a pressure differential across the housing proximate the gap. In some examples herein, the terms fan, blower, and pressure source may be regarded as synonymous, and in some examples may be regarded as synonymous with any device to create a negative pressure.

The controller that, in some examples, performs blocks 404-408 may be the controller 310 as described above with reference to FIG. 3, and may comprise the processor that performs block 402. The controller may be to operate a fan, or a plurality of fans, to create the pressure differential. In other examples the controller may be to operate a fan, or a plurality of fans, to control or regulate the suction pressure in a conduit, or a plurality of conduits, to create the pressure differential.

Figure 5:
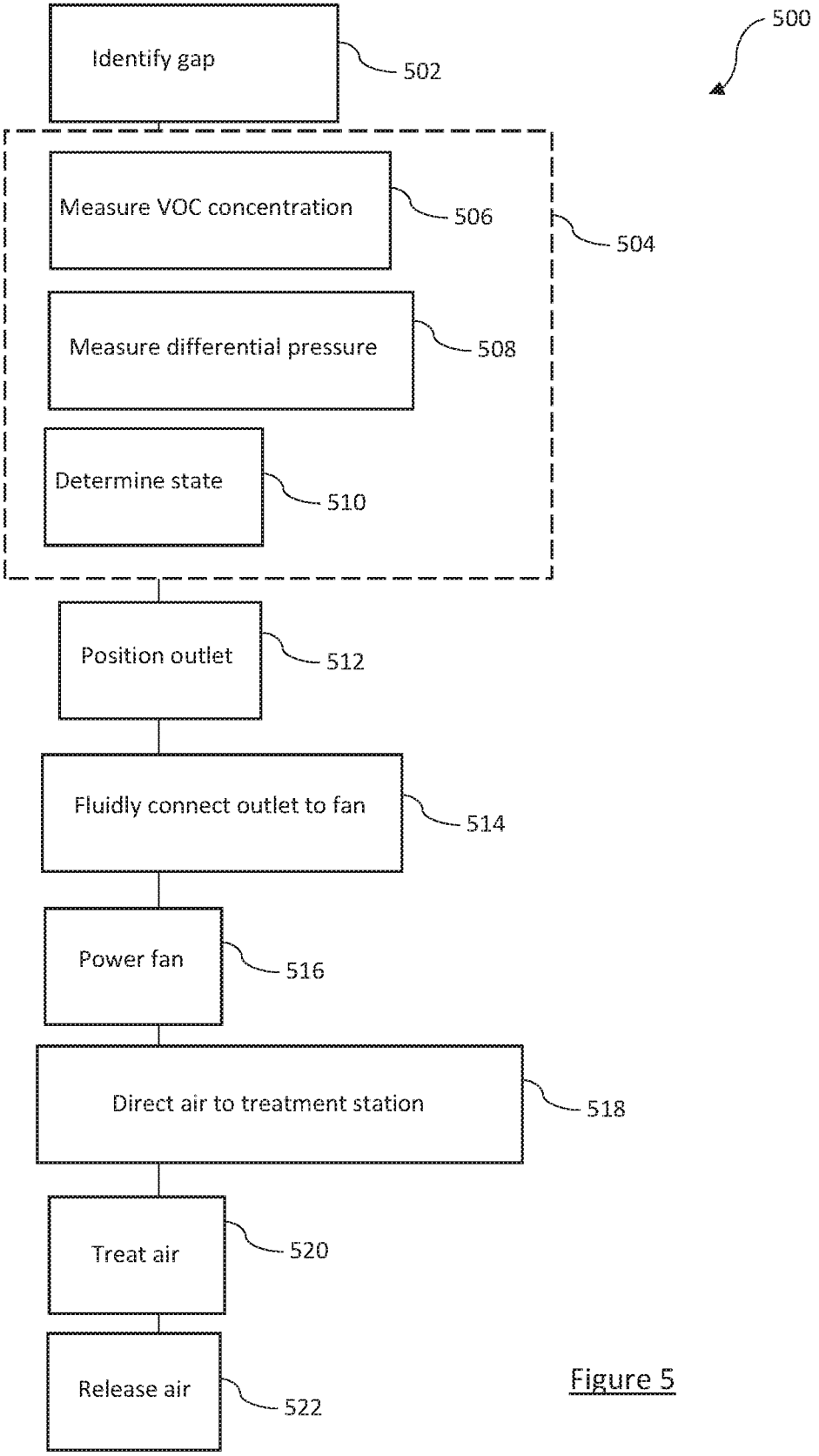
FIG. 5 is a flowchart of an example of a method.

FIG. 5 shows an example method 500, which may be a method of reducing emissions from inside a printing apparatus, or which may be a method of reducing the concentration of volatile organic compounds in the region of a printing apparatus. The method 500 may comprise a computer-implemented method. The method 500 may comprise the method 400 as described with reference to FIG. 4.

At block 502, the method comprises identifying, by a processor (e.g. the processor as described above with reference to block 402) a gap in a housing of a printing apparatus, for example as described above with reference to block 402 of the method 400.

At block 504, the method comprises determining, e.g. by a processor or controller, a condition of the printing apparatus based on which the controller is to create the pressure differential. For example, the method may comprise, at block 506, measuring (e.g. by sensor, for example under the control of the processor or controller) the VOC concentration of air at a location within the printing apparatus. The method may comprise, at block 508, measuring the differential pressure (e.g. by a sensor, for example under the control of the processor or controller, and which may be the same sensor as described with reference to block 506) at a location within the printing apparatus. The method may comprise, at block 510, determining (e.g. by a processor or controller) a state of the printing apparatus. In one example, the method may comprise any of blocks 506-510.

At block 512, the method comprises positioning an inlet of a conduit inside the housing proximate the gap, for example as described above with reference to block 404 of the method 400. For example, block 512 may comprise positioning the inlet based on the measured concentration (block 506) and/or the measured differential air pressure (block 508) and/or the state of the printing apparatus (block 510).

At block 514, the method comprises fluidly connecting the inlet to a fan, for example as described above with reference to block 406 of the method 400.

At block 516, the method comprises powering the fan to create a pressure differential across the housing such that air inside the housing is unable to escape the housing via the gap, for example as described above with reference to block 408 of the method 400. For example, block 512 may comprise adjusting the fan speed to create the pressure differential. In another example block 512 may comprise adjusting the air flow rate in the conduit to create the pressure differential. Block 512 may comprise adjusting the fan speed and/or the air flow rate based on the measured concentration (block 506) and/or the measured differential air pressure (block 508) and/or the state of the printing apparatus (block 510). Adjusting, at block 512, may be done by a processor (e.g. the same processor as described above) or a controller.

At block 518, the method comprises directing air taken from the housing, the air inside the printing apparatus drawn by the fan through the conduit to create the pressure differential, to a treatment station to treat the air. Treating the air in this example comprises reducing the VOC concentration of the air. Accordingly, block 520 of the method comprises treating the air and block 522 of the method comprises releasing the treated air into the environment. Block 520, at which the air is treated, in one example, may comprise heating the air, passing the heated air through a catalytic converter, and cooling the air. In another example, block 520 may comprise passing the air through a filter.

Returning to block 504 of the method, when the VOC concentration is determined, at block 506, then positioning the inlet, at block 512, may be done based on the determined concentration. For example, block 512 may comprise positioning the conduit at a location at which the VOC concentration is determined to be the lowest (e.g. a minimum), to create the pressure differential, so that the drawn air needs a lesser degree of treatment being of a lower concentration, and this will reduce the amount of air that needs to be treated. When the differential pressure is measured, at block 508, then positioning the inlet, at block 512, may be done based on the determined pressure differential. For example, block 512 may comprise positioning the conduit at a location at which the pressure differential is the lowest so as to increase the pressure differential at that location. For example, it may be determined that a pressure differential proximate a gap is not sufficient for air not to escape in which case the controller may position the conduit proximate the gap. When the state of the printing apparatus is determined, at block 510, then positioning the inlet, at block 512, may be done based on the state of the printing apparatus. For example, block 512 may comprise positioning the conduit inlet at a location where it is determined the printing apparatus is in a state during which production of VOCs is likely. In other words, the inlet may be positioned at a location in a printing station near where a print job will occur, or is occurring. In some examples, any combination of the determinations at blocks 506-510 may be performed.

For example, it may be determined that a particular printing station of a printing apparatus is not going to be used for a particular black and white print job, and that a black and white printing station will be ON or ACTIVE. A VOC concentration sensor, or measuring device, may determine that VOC concentration is high proximate the ink carriage and that there are gaps in the printing apparatus toward the bottom of the printing apparatus. The pressure differential may be lowest proximate one of those gaps and, accordingly (e.g. at block 512) conduits may be positioned and the suction pressure in those conduits may be regulated (e.g. by powering a fan, or a plurality of fans, at block 516) so that a greater pressure. In another example it may be determined that a particular printing apparatus state will have a higher VOC concentration than another, for example a "print" state versus a "get ready" state. In the "get ready" state there may not be any additional production of VOCs from the printing apparatus and therefore the VOC concentration in any air being emitted from the apparatus may be considered to be evenly distributed. On the other hand, in the "print" state, the concentration may be determined to be the highest proximate the an ITM (e.g. an ITM drum) and therefore in this example the method may comprise positioning conduits proximate the ITM.

Figure 6:
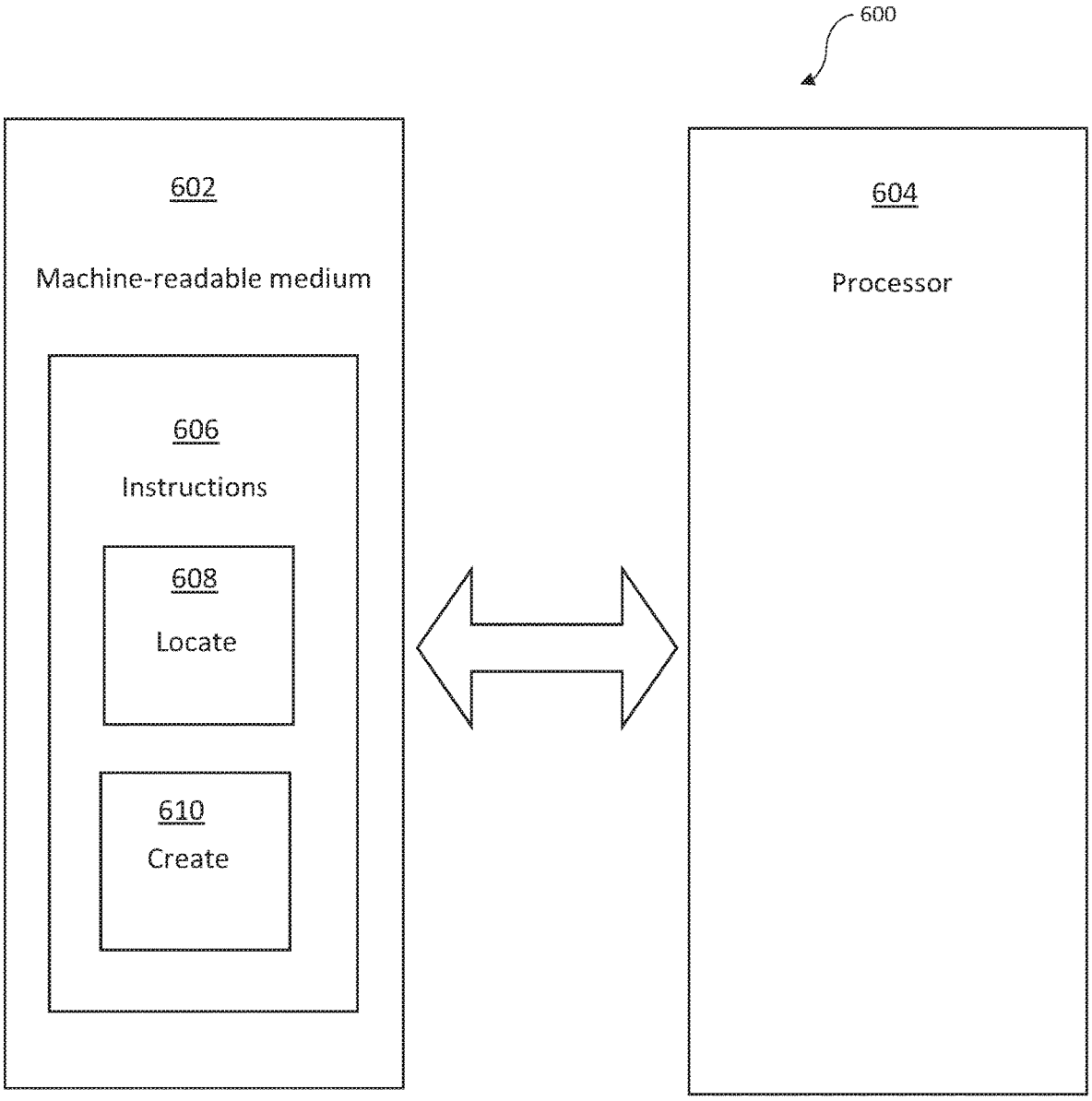
FIG. 6 is a schematic diagram of a machine-readable medium in association with a processor.

FIG. 6 shows an example tangible (and non-transitory) machine-readable medium 602 in association with a processor 604. The machine-readable medium 602 may be part of a system or apparatus for reducing emissions from inside a printing apparatus, or reducing the concentration of volatile organic compounds in the region of a printing apparatus, or for creating a pressure state in a printing apparatus.

The tangible machine-readable medium 602 comprises instructions 606 which, when executed by the processor 604, cause the processor 604 to carry out a plurality of tasks. The instructions 606 comprise instructions 608 to locate an opening in an exterior casing of a printing system via which air form inside the printing system may escape. The instructions 606 comprise instructions 610 to create a pressure state within the printing system proximate the opening such that air from outside the printing system is drawn inside the printing system via the opening.

The machine-readable medium 602 may therefore comprise instructions stored thereon that, when executed by the processor, create an under-pressure in a printing system, for example proximate the opening, so that air at potentially high levels of VOCs is not able to escape via the opening, since the pressure state will draw air into the printing system via the opening from outside the printing system. The pressure state is therefore to ensure that air is drawn inside the printing system so that air inside the system cannot migrate outside the printing system.

In an example, the instructions 606 may comprise instructions that, when executed by the processor, cause the processor to operate a plurality of blowers to create the pressure state. In an example, the instructions 606 may comprise instructions that, when executed by the processor, cause the processor to control the pressure in a number of conduits (the conduits being connected to a plurality of blowers or to a single blower) to create the pressure state. In this example, the instructions 606 may comprise instructions that, when executed by the processor, cause the processor to select and/or control the pressure in each conduit to create the pressure state proximate the opening. For example, the printing system may comprise a plurality of openings and one, or a plurality of, blower(s) may be used to create the pressure state proximate each opening, and the pressure in a plurality of conduits may be regulated depending on the differential pressures proximate each opening. For example, a larger conduit may be positioned proximate a larger opening and operated at a higher suction pressure.

Figure 7:
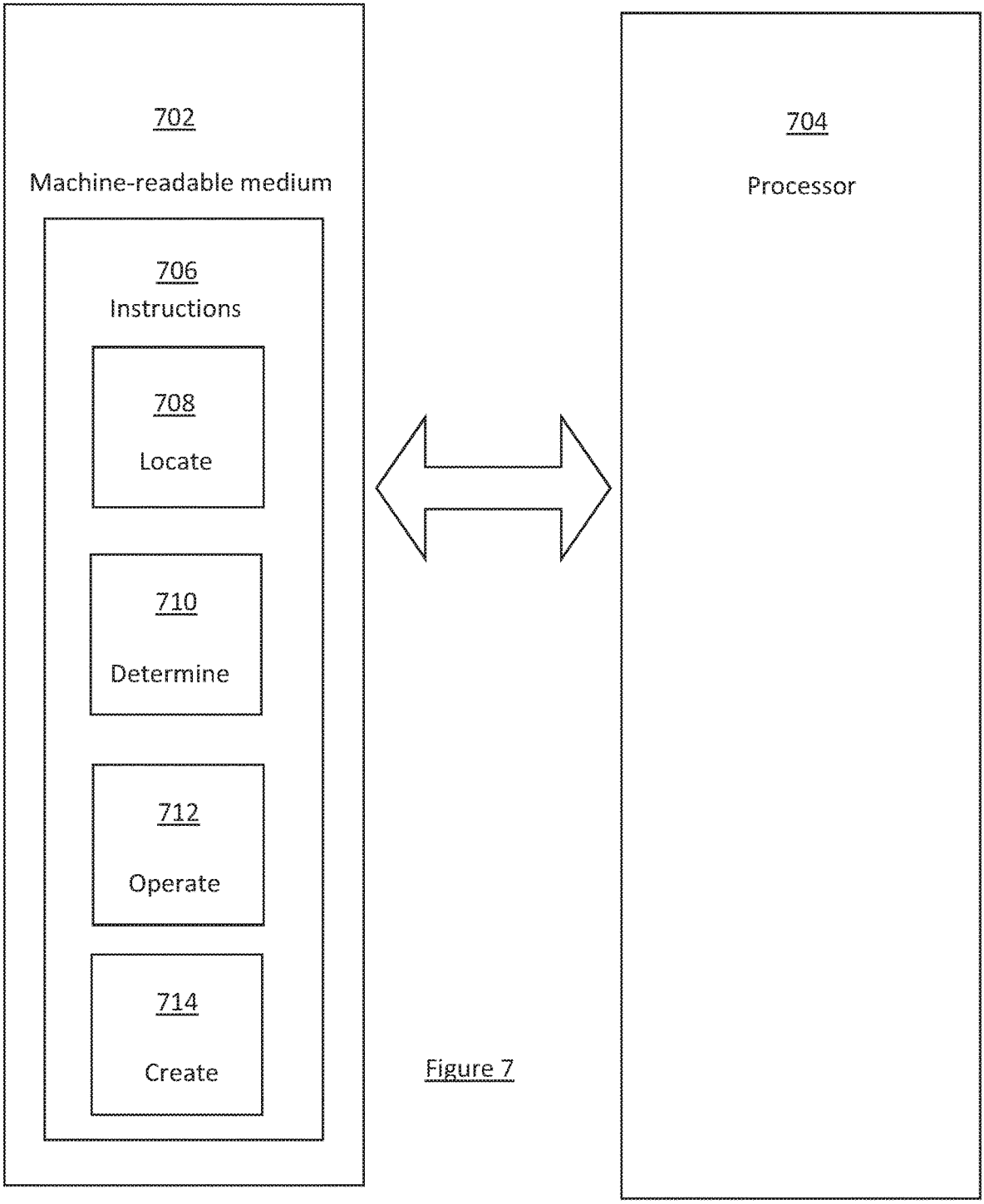
FIG. 7 is a schematic diagram of a machine-readable medium in association with a processor.

FIG. 7 shows an example tangible (and non-transitory) machine-readable medium 702 in association with a processor 704, and which may comprise the machine-readable medium 602 as described above with reference to the example medium 600 of FIG. 6. The tangible machine-readable medium 702 comprises instructions 706 which, when executed by the processor 704, cause the processor 704 to carry out a plurality of tasks. The instructions 706 comprise instructions 708 that, when executed by the processor 704, cause the processor 704 to locate an opening in an exterior casing of a printing system via which air from inside the printing system may escape, for example as described above with reference to the instructions 602 of the medium 600.

The instructions 706 comprise instructions 710 that, when executed by the processor 704, cause the processor 704 to determine a condition of the printing apparatus based on which the processor is to create the pressure differential. For example, the instructions 710 may cause the processor to determine (e.g. by a sensor, for example by receiving feedback from a sensor) the VOC concentration of air inside the printing system. The instructions 710 may cause the processor to determine the differential pressure (e.g. by a sensor under the control of a controller) at a location within the printing apparatus. The instructions 710 may cause the processor to determine (e.g. by a controller) a state of the printing apparatus. The instructions 706 may also comprise instructions that, when executed by the processor 704, cause the processor 704 to determine the state of the printing apparatus.

The instructions 706 comprise instructions 712 that, when executed by the processor 704, cause the processor 704 to operate the flower to create the pressure state by drawing air from within the printing system at a location based on the determination of the processor, caused by the instructions 710 as describe above. For example the instructions 712 may cause the processor 704 to operate the blower to create the pressure state by drawing air from a location where the concentration of VOCs is determined the be the lowest, or at a location based on the determined differential pressure, for example where the differential pressure is determined to be the lowest.

The instructions 706 comprise instructions 714 that, when executed by the processor 704, cause the processor 704 to create a pressure state within the printing system proximate the opening such that air from outside the printing system is drawn inside the printing system via the opening, for example as described above with reference to instructions 610 of the medium 602. Therefore, the blower may be operated based on the VOC concentration and/or a pressure differential at a location of the printing system, and/or the state of the printing system (for example whether the printing system is printing). The pressure state of the printing system (e.g. the under-pressure) may therefore be created by a controller based on VOC concentration, existing differential pressure, or the printing system state.

Some example methods, apparatuses and systems described herein reduce emissions from printing apparatuses/systems based on creating an under-pressure within the system such that air inside the system (at potentially high levels of VOCs) is not able to escape. In this way the printing systems will be prevented from emitting air from within and so VOC emissions may be reduced. However, reducing the emissions by creating an under-pressure in the vicinity of any gaps or openings in the casing (or housing) may mean, in some examples, that a small amount of air may be drawn to create the under-pressure, since a small amount of air may be taken proximate an identified gap in order to create the pressure differential so that air is not able to escape. In other words, a small amount of air may be drawn from a particular location to create the pressure difference or state. In turn, drawing a small amount of air means that the amount of air to be treated is less. Furthermore, as air is drawn proximate a gap air may be drawn from a location independent of the concentration of VOCs at that location. In this way, an operator may choose to draw air from a location that has a lower concentration of VOCs. The examples presented herein may therefore be more cost effective (for example, treating lower volumes of air) and simple to implement in existing systems.

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method comprising:

identifying, by a processor, a gap in a housing of a printing apparatus;

positioning, an inlet of a conduit inside the housing;

fluidly connecting the inlet to a fan;

powering the fan to create a pressure differential across the housing to minimize the amount of air inside the housing being able to escape the housing via the gap.

2. A method as claimed in claim 1 further comprising:

directing air taken from the housing to a treatment station; and treating the air at the treatment station.

3. A method as claimed in claim 2, further comprising:

releasing the treated air into the environment.

4. A method as claimed in claim 1, further comprising:

measuring, by a sensor, the concentration of a volatile organic compound within the printing apparatus; and adjusting, by a processor, the air flow rate in the conduit, or positioning the inlet, based on the measured concentration.

5. A method as claimed in claim 1, further comprising:

measuring, by a sensor the differential pressure at a location in the printing apparatus; and adjusting, by a processor, the air flow rate in the conduit, or positioning the inlet, based on the measured differential air pressure.

6. A method as claimed in claim 1, further comprising:

determining, by a processor, a state of the printing apparatus; and

Adjusting, by a processor, the air flow rate in the conduit, or positioning the inlet, based on the state of the printing apparatus.

7. A method as claimed in claim 1 further comprising:

identifying, by a processor, a plurality of gaps in the housing;

positioning each of a plurality of conduit inlets inside the housing;

fluidly connecting each inlet to a respective fan in a plurality of fans;

powering each fan to create a pressure differential across each gap to minimize the amount of air inside the housing being able to escape the housing via the gap.

8. A printing apparatus comprising:

a casing for a printing element of the printing apparatus, the casing comprising a gap through which air may pass from the inside to the outside of the printing apparatus;

a pressure source to create a suction pressure;

a conduit fluidly connected to the pressure source and positioned so as to create a pressure differential across the casing to minimize the amount of air inside the casing being able to escape the casing via the gap.

9. A printing apparatus as claimed in claim 8, the printing apparatus further comprising:

a controller to determine a state of the printing apparatus and to regulate the suction pressure of the pressure source based on the determined state.

10. A printing apparatus as claimed in claim 8, the printing apparatus further comprising:

a plurality of conduits connected to the pressure source; and a controller to regulate the suction pressure in each of the plurality of conduits.

11. A printing apparatus as claimed in claim 8, the printing apparatus further comprising:

a concentration sensor to determine the concentration of a volatile organic compound within the printing apparatus; and a controller to regulate the suction pressure in the conduit such that air is drawn from a location with the lowest concentration of volatile organic compounds.

12. A printing apparatus as claimed in claim 11, the printing apparatus further comprising:

a differential pressure sensor to determine the differential pressure at a location within the printing apparatus; and a controller to regulate the suction pressure in the conduit based on the determined differential pressure.

13. A non-transitory computer-readable storage medium comprising a set of computer-readable instructions stored thereon, which, when executed by a processor of a printing system cause the processor to:

locate an opening in an exterior casing of a printing system via which air from inside the printing system may escape; and to create a pressure state within the printing system proximate the opening such that air from outside the printing system is drawn inside the printing system via the opening.

14. A non-transitory computer-readable storage medium as claimed in claim 13, wherein the instructions, when executed by the processor, cause the processor to:

determine the concentration of volatile organic compounds in the air inside the printing system; and operate a blower to create the pressure state by drawing air from within the printing system from a location where the concentration of volatile organic compounds is determined to be the lowest.

15. A non-transitory computer-readable storage medium as claimed in claim 13, when executed by the processor, cause the processor to:

determine the differential pressure inside the printing system; and operate a blower to create the pressure state by drawing air from within the printing system from a location based on the determined differential pressure.

* * * * *